United States Patent [19]

Kimball et al.

[11] 4,296,351

[45] Oct. 20, 1981

[54] TUNGSTEN HALOGEN LAMP HAVING LEAD-IN WIRE COMPRISING TANTALUM ALLOY

[75] Inventors: Stephen F. Kimball, North Andover; Peter R. Gagnon, Salem, both of Mass.

[73] Assignee: GTE Products Corporation, Stamford, Conn.

[21] Appl. No.: 86,182

[22] Filed: Oct. 17, 1979

[51] Int. Cl.[3] ..... H01K 1/28

[52] U.S. Cl. ..... 313/222; 313/178; 313/271; 313/316

[58] Field of Search ..... 313/222, 178, 316, 315, 313/272, 271

[56] References Cited

U.S. PATENT DOCUMENTS

| | | | |
|---|---|---|---|
| 2,067,129 | 1/1937 | Marden | 313/271 X |
| 3,544,829 | 12/1970 | Someya et al. | 313/178 |
| 3,549,933 | 12/1970 | Smalley | 313/315 X |
| 3,549,937 | 12/1970 | Handa et al. | 313/178 |
| 3,668,391 | 6/1972 | Kimball | 313/315 X |
| 3,721,852 | 3/1973 | Chiola et al. | 313/325 X |
| 4,015,157 | 3/1977 | Roller et al. | 313/271 X |

*Primary Examiner*—Stanley T. Krawczewicz

*Attorney, Agent, or Firm*—James Theodosopoulos

[57] ABSTRACT

Tungsten halogen incandescent lamps comprise tungsten filaments having different tungsten evaporation rates during normal operation. The filaments are supported on lead-in wires made of an alloy including tantalum.

10 Claims, 1 Drawing Figure

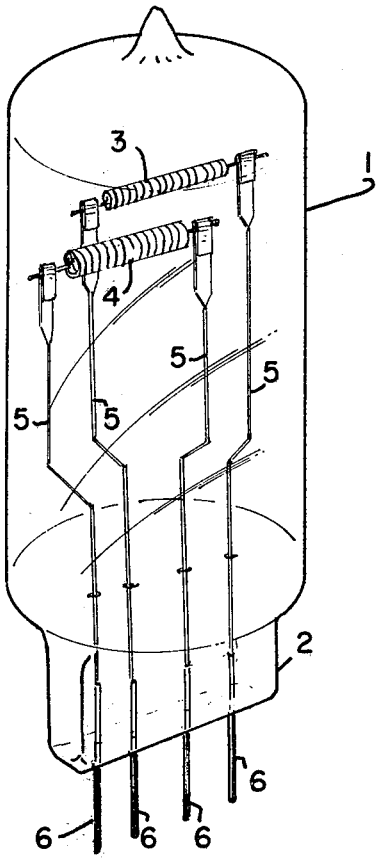
3
1
4
5
5
5
5
2
6
6
6
6

TUNGSTEN HALOGEN LAMP HAVING LEAD-IN WIRE COMPRISING TANTALUM ALLOY

TECHNICAL FIELD

This invention is concerned with tungsten halogen incandescent lamps. Such lamps comprise a tungsten filament within a quartz or hard glass envelope. The envelope contains a fill of inert gas and a halogen in elemental or compound form.

BACKGROUND ART

Examples of single-filament tungsten halogen lamps are shown in U.S. Pat. Nos. 3,829,729 and 3,849,687. Examples of double-filament tungsten halogen lamps are shown in U.S. Pat. Nos. 3,801,178 and 4,140,939.

This invention is concerned with such lamps in which the filament or filaments operate at different temperatures during normal operation and, therefore, evaporate tungsten at different rates. Such operation makes it difficult to determine the optimum quantity of halogen to be added. If an excess is used, halogen attack of the filament or other lamp components can occur. If a deficiency is used, bulb blackening can occur. For example, in a double filament lamp where the tungsten evaporation from the filaments occurs at different rates and when the amount of halogen is based on the filament having the higher evaporation rate, then the other filament will be halogen attacked during its normal operation. But if the amount of halogen is based on the filament having the lower evaporation rate, then bulb blackening will occur during normal operation of the other filament. A compromise amount of halogen does not always yield satisfactory results.

DISCLOSURE OF THE INVENTION

We have found that when such lamps are made with a lead-in wire comprising an alloy of tantalum, the lamps can be operated cleanly for their rated lives without regard for which filament is operated. This use of tantalum alloy is different from the use of tantalum metal as a getter, as disclosed in U.S. Pat. Nos. 3,644,773, 3,748,519, 3,829,729 and 3,849,687. The lead-in wire should be suitably sealable to the glass envelope and should predominantly comprise a refractory metal such as tungsten or molybdenum. Tantalum, alone is not so suitably sealable.

BRIEF DESCRIPTION OF DRAWING

The drawing is an elevational view of a tungsten halogen lamp in accordance with this invention.

BEST MODE FOR CARRYING OUT THE INVENTION

A tungsten halogen lamp in accordance with this invention comprises a hard glass envelope 1 having a press seal 2 at one end thereof. Disposed within envelope 1 are two tungsten filaments 3 and 4. The filaments are connected to lead-in wires 5 which are connected to externally extending wires 6. Lead-in wires 5 are made of an alloy of molybdenum and tantalum and are supported in press seal 2. Envelope 1 contains a gaseous filling of krypton and hydrogen bromide.

In a specific example of a tungsten halogen lamp for use in an automobile headlight, envelope 1 was made of 40 mil thick type 1720 T5 ignition glass and was about 1¼' long. Tungsten filament 3 was a low beam 14 volt, 35 watt filament rated at 320 hours life and operating at about 3000° K. Tungsten filament 4 was a high beam 14 volt, 65 watt filament rated at 150 hours life and operating at about 3200° K. Lead-in wires 5 were made of 13 mil 97% molybdenum-3% tantalum alloy and were clamped around the ends of filaments 3 and 4. Lead-in wires 5 were butt welded to wires 6, which comprised 40 mil diameter 8% nickel plated type 1006 steel wires. The gaseous fill within envelope 1 was 6 atmospheres krypton containing a small quantity of hydrogen bromide.

Lamps as per this invention were compared with lamps in which lead-in wires 5 consisted of molybdenum without tantalum. In one test the krypton contained 0.41% hydrogen bromide. In this test, in the lamps without tantalum, the low beam filament had noticeable spikes from high bromide activity after only 109 hours of operation while in the lamps with the molybdenum-tantalum alloy, the low beam filament operated satisfactorily for 202 hours when the test was discontinued. In the lamps without tantalum, the high beam filaments either failed or caused noticeable black deposits in 202 hours, while in the lamps with the molybdenum-tantalum alloy, the high beam filaments operated satisfactorily for 202 hours.

In another test where the krypton contained 0.78% hydrogen bromide, the low beam filaments failed in the lamp without tantalum in 63 hours from high bromine activity, while in the lamps with the molybdenum-tantalum alloy the low beam filaments lasted at least 202 hours, although they did show the results of high bromine activity. Similarly, the high beam filaments in the lamp as per this invention lasted longer than those in the lamp without tantalum.

Although the invention has been particularly described in connection with a double filament lamp in which the two filaments have different tungsten evaporation rates during normal operation, it can also be used in a single filament lamp having two different normal operating voltages, that is to say, two different tungsten evaporation rates. Also, although the invention has been particularly described with reference to tantalum as the buffering metal that buffers halogen action and permits operation at two different filament evaporation rates, other buffering metals may be used such as, for example, high melting point polyvalent metals such as zirconium, hafnium and nickel.

We claim:

1. A tungsten halogen incandescent lamp comprising two tungsten filaments supported on lead-in wires and disposed within a glass envelope, the glass envelope containing a fill of inert gas and halogen in elemental or compound form, the two tungsten filaments having different tungsten evaporation rates during normal operation, the lead-in wires comprising an alloy including tantalum the purpose of which is to provide satisfactory lamp operation at the two different tungsten evaporation rates.

2. The lamp of claim 1 wherein the lead-in wires comprise predominantly a refractory metal.

3. The lamp of claim 1 wherein the envelope is made of hard glass and the lead-in wires are satisfactorily sealable thereto.

4. The lamp of claim 1 wherein said alloy comprises molybdenum and tantalum.

5. A tungsten halogen incandescent lamp comprising a tungsten filament supported on lead-in wires and disposed within a glass envelope, the glass envelope containing a fill of inert gas and halogen in elemental or compound form, the lamp having two different normal operating voltages under which conditions the filament has two different tungsten evaporation rates, the lead-in wires comprising an alloy including tantalum the purpose of which is to provide satisfactory lamp performance at the two different tungsten evaporation rates.

6. The lamp of claim 5 wherein the lead-in wires comprise predominantly a refractory metal.

7. The lamp of claim 6 wherein the envelope is made of hard glass and the lead-in wires are readily sealable thereto.

8. The lamp of claim 5 wherein said alloy comprises molybdenum and tantalum.

9. A tungsten halogen incandescent lamp comprising a tungsten filament supported on lead-in wires and disposed within a glass envelope, the glass envelope containing a fill of inert gas and halogen in elemental or compound form, the filament having different tungsten evaporation rates during normal operation, and a buffering metal disposed within the envelope that buffers halogen action and permits satisfactory lamp operation at different tungsten evaporation rates.

10. A tungsten halogen incandescent lamp comprising a plurality of tungsten filaments supported on lead-in wires and disposed within a glass envelope, the glass envelope containing a fill of inert gas and halogen in elemental or compound form, the filaments having different tungsten evaporation rates during normal operation, and a buffering metal disposed within the envelope that buffers halogen action and permits satisfactory lamp operation at different tungsten evaporation rates.

* * * * *